US009994963B2

(12) United States Patent
Carroll et al.

(10) Patent No.: US 9,994,963 B2
(45) Date of Patent: Jun. 12, 2018

(54) OUTLET SEAL FOR THE CATHODE BARS OF AN ALUMINUM ELECTROLYTIC CELL

(71) Applicant: Mid-Mountain Materials, Inc., Mercer Island, WA (US)

(72) Inventors: Tony Carroll, Evansville, IN (US); Yuri Nikolaevich Popov, Krasnoyarsk (RU)

(73) Assignee: Mid-Mountain Materials, Inc., Mercer Island, WA (US)

( * ) Notice: Subject to any disclaimer, the term of this patent is extended or adjusted under 35 U.S.C. 154(b) by 136 days.

(21) Appl. No.: 13/932,773

(22) Filed: Jul. 1, 2013

(65) Prior Publication Data

US 2013/0299344 A1 Nov. 14, 2013

Related U.S. Application Data

(63) Continuation of application No. PCT/RU2011/001025, filed on Dec. 26, 2011.

(30) Foreign Application Priority Data

Dec. 30, 2010 (RU) ..... 2010154820

(51) Int. Cl.
*C25C 7/00* (2006.01)
*C25C 3/08* (2006.01)

(52) U.S. Cl.
CPC ..... *C25C 7/00* (2013.01); *C25C 3/085* (2013.01); *C25C 3/08* (2013.01)

(58) Field of Classification Search
CPC .... C25C 3/06; C25C 3/08; C25C 3/10; C25C 3/16; C25C 7/00; C25C 3/085
USPC ..... 204/279
See application file for complete search history.

(56) References Cited

U.S. PATENT DOCUMENTS 4,033,836 A 7/1977 Holmes
5,826,886 A * 10/1998 Hauff et al. ..... 277/314

FOREIGN PATENT DOCUMENTS

| | | | |
|---|---|---|---|
| FR | 2535537 | A1 | 5/1984 |
| JP | 8017399 | A | 1/1996 |
| RU | 1 739 682 | C | 1/1995 |
| RU | 2 095 485 | C1 | 11/1997 |
| RU | 2 108 414 | C1 | 4/1998 |
| RU | 2 281 347 | C1 | 8/2006 |

(Continued)

OTHER PUBLICATIONS

Gromov et al (Machine translation of RU 2,108,414).*

(Continued)

*Primary Examiner* — Luan V Van
*Assistant Examiner* — Alexander W Keeling
(74) *Attorney, Agent, or Firm* — Christensen O'Connor Johnson Kindness PLLC

(57) ABSTRACT

Sealing devices are provided as configured for use with cathode devices of an electrolytic cell for production of aluminum. In particular, the seals are specifically configured to provide an outlet seal for the cathode bars. The sealing devices are made of a material that is elastic, gas-proof, and heat-proof, and can create a hermetic seal around the cathode bar in such a way as to be able to move synchronously or asynchronously with the movement of the cathode bar as it undergoes thermally induced movement during aluminum production.

4 Claims, 2 Drawing Sheets

(56) References Cited

FOREIGN PATENT DOCUMENTS

| | | | |
|---|---|---|---|
| SU | 865992 | A1 | 9/1981 |
| WO | 2012/091633 | A2 | 7/2012 |

OTHER PUBLICATIONS

Kosarev et al (Machine translation of SU 865,992).*
AZO Mateirals, Refractories—An Introduction to the Types of Monolithic Refractories, 2012, http://www.azom.com/article.aspx?ArticleID=1408.*
International Search Report mailed Jun. 7, 2012, in corresponding International Application No. PCT/RU2011/001025, filed Dec. 26, 2011, 4 pages.
International Search Report and Written Opinion mailed Nov. 14, 2013, issued in corresponding International Application No. PCT/US2013/032427, filed Mar. 15, 2013, 8 pages.

* cited by examiner

OUTLET SEAL FOR THE CATHODE BARS OF AN ALUMINUM ELECTROLYTIC CELL

CROSS-REFERENCE(S) TO RELATED APPLICATION(S)

This application is a continuation of International Application No. PCT/RU2011/001025, filed Dec. 26, 2011, which claims priority to Russian Patent Application No. 2010154820, filed Dec. 30, 2010, the disclosures of which are expressly incorporated by reference herein in their entirety.

BACKGROUND

There is a known outlet seal for the cathode bars of an aluminum electrolytic cell (USSR Inventor's Certificate No. 865992, IPC C 25 C 3/16, 1981), containing a branch pipe narrowing in the direction away from the shell and connected to the cathode shell, a thrust ring connected to the outer end of the branch pipe, a sealing gland, a cathode bar, a flange joined to the cathode bar, and a layer of alumina.

The drawback of the known seal is that the sealing gland and the layer of alumina are gas permeable. Also during the period of firing and startup of the aluminum electrolytic cell and in the process of operation the cathode bar shifts along its axis due to thermal expansion, and the cathode bar shifts transversely to its axis as a result of sodium expansion of the carbon portion of the lining. This leads to disruption of the tightness of the seal due to the inability of the sealing gland to compensate for the transverse displacement of the cathode bar and the wear caused by its axial displacement. Air gets in through the sealing gland and the layer of alumina and disrupts the tightness of the carbon side lining, oxidizing and destroying it. This lowers the service life of the aluminum electrolytic cell and quite often is the cause of melt breakthrough and leakage through the apertures for passage of the cathode bars that are cut out from the lengthwise walls of the cathode shell. Furthermore, one should mention the labor intensity and length of time to perform the installation work involved in filling the free space around the cathode bar with a seal.

There is a known outlet seal for the cathode bars of an aluminum electrolytic cell (RF patent No. 2281347, IPC C25C 3/08, 2006), containing a plate with an opening, situated on the inside of the apertures for passage of the cathode bars that are made in the cathode shell, and a sylphon hermetically connected by one end to the cathode bar and by the other to the cathode shell. In this device, the plate with opening is seated on the cathode bar with ability to move along its axis and cover the apertures.

The drawbacks of the known seal are:

since the cathode bar is a rolled product, its surface has irregularities and consequently aggressive gases (especially HF) pass inside the sylphon in the gap between the cathode bar and the plate during the firing and startup of the electrolytic cell and bring about corrosion and loss of tightness;

the sylphon due to its principle of operation has a developed surface area of folds and an internal space volume and therefore if it is filled with sealant it has an elevated outlay of sealant, i.e., a high cost price and labor intensity;

the sylphon has a fixed connection of both its ends, and consequently it is not possible to add elastic sealant inside the sylphon during its operation, if necessary.

The closest to the present disclosure in its set of essential features is a seal (RF patent No. 2108414, IPC C25C 3/08, 1998) containing a sealing means around the cathode bar, a metal box with two openings joined to the cathode shell with apertures for passage of the cathode bars, and a layer of material allowing the cathode bar to slide relative to the sealing means.

The drawback of the prototype is that during the period of firing and startup of the aluminum electrolytic cell and in the process of operation the cathode bar shifts along its axis due to thermal expansion, and the cathode bar shifts transversely to its axis as a result of sodium expansion of the carbon portion of the lining. Since the cathode bar is a rolled product, its surface has irregularities. Due to the axial displacement between the cathode bar and the solidified sealing means, gaps are formed. As a result of the transverse displacement of the cathode bar, destruction of the solidified sealing means occurs. Air gets in through the gaps forming in the lateral carbon lining, oxidizing and destroying it. This lowers the service life of the aluminum electrolytic cell and quite often is the cause of melt breakthrough and leakage through the apertures for passage of the cathode bars that are cut out from the lengthwise walls of the cathode shell. Furthermore, one should mention the labor intensity and length of time to perform the installation work involved in filling the free space around the cathode bar with a seal.

SUMMARY

This summary is provided to produce a selection of concepts in a simplified form that are further described below in the Detailed Description. This summary is not intended to identify key features of the claimed subject matter, nor is it intended to be used as an aid in determining the scope of the claimed subject matter.

In one aspect, an outlet seal for a cathode bar of an aluminum electrolytic cell, is provided. In one embodiment, the outlet seal includes a device connected to a lined cathode shell having an aperture for the passage of the cathode bar situated on a face side of the electrolytic cell, characterized in that a plate with an opening is arranged on an inner side of the aperture for the passage of cathode bar, around its periphery, with the ability to move along the cathode bar and cover the aperture; wherein the device is made of a material that is elastic, gas-proof, and heat-proof, in the form of a sleeve that is hermetically connected by one end to the cathode shell, narrows in a direction away from the cathode shell, and hugs the cathode bar around the perimeter of its cross section in such a way as to be able to move synchronously or asynchronously with the movement of the cathode bar; wherein the device contains a sealant comprising an elastic, fire-proof, gas-proof, unshaped filler, that is configured to allow the cathode bar to slide relative to the cathode shell, and ensure that the seal is tight.

In another aspect, a sealing sleeve for a cathode bar of an aluminum electrolytic cell is provided. In one embodiment, the sealing sleeve includes a cathode shell having an aperture for the passage of the cathode bar situated on a face side of the electrolytic cell;

wherein the sealing sleeve is configured to hermetically connect at one end to the cathode shell, narrow in a direction away from the cathode shell, and seal to the cathode bar around a perimeter of its cross section in such a way as to allow synchronous or asynchronous movement of the sealing sleeve with movement of the cathode bar; and wherein the sealing sleeve is made of a material that is elastic, gas-proof, and heat-proof.

DESCRIPTION OF THE DRAWINGS

The foregoing aspects and many of the attendant advantages of this invention will become more readily appreciated as the same become better understood by reference to the following detailed description, when taken in conjunction with the accompanying drawing, wherein.

DETAILED DESCRIPTION

The disclosure pertains to the electrolytic production of aluminum, in particular, cathode devices of an electrolytic cell for production of aluminum, and specifically the outlet seal for the cathode bars.

The problem of the disclosure is to increase the service life of an aluminum electrolytic cell, lower the labor intensity for performance of installation work, and improve the ecology.

The technical result is an outlet sealing of the cathode bars of an aluminum electrolytic cell by preventing the penetration of the oxygen of air inside the cathode shell of the electrolytic cell and oxidation at high temperature and destruction of the inner lining, the side and cathode blocks, and also preventing the penetration of aggressive gases, especially hydrogen fluoride (HF), from inside the cathode of the electrolytic cell to the outside of the shell and ensuring a combination of sealing effects acting at the same time, namely, (a) elasticity of the elements upon displacement of the cathode bars in the longitudinal and transverse planes, (b) chemical resistance to aggressive gases, especially oxygen and HF, (c) thermal resistance, which taken together ensure a long-lasting integrity and tightness of the seal, consequently increasing the service life of the electrolytic cell and improving the ecology.

The stated problem is solved in that, in an outlet seal for the cathode bars of the aluminum electrolytic cell, containing a device connected to a lined cathode shell having apertures for the passage of cathode bars for accommodating a sealing means, situated on the face side of the electrolytic cell, according to the design being declared, a plate with an opening is arranged on the inner side of the aperture for the passage of cathode bars, around its periphery, with the ability to move along the cathode bar and cover the aperture, and the device for accommodating the sealing means is made of elastic, gas-proof and heat-proof material in the form of a sleeve that is hermetically connected by one end to the cathode shell, narrows in a direction away from the cathode shell and hugs the cathode shell around the perimeter of its cross section in such a way as to be able to move synchronously or asynchronously with the movement of the cathode bar, while the sealing means consists of an elastic, fire-proof, gas-proof, unshaped filler, and it is also disposed in the gap formed by the cathode bar and the wall of the cathode shell, and it allows the cathode bar to slide relative to the cathode shell and ensures that the seal is tight.

Figure 1:
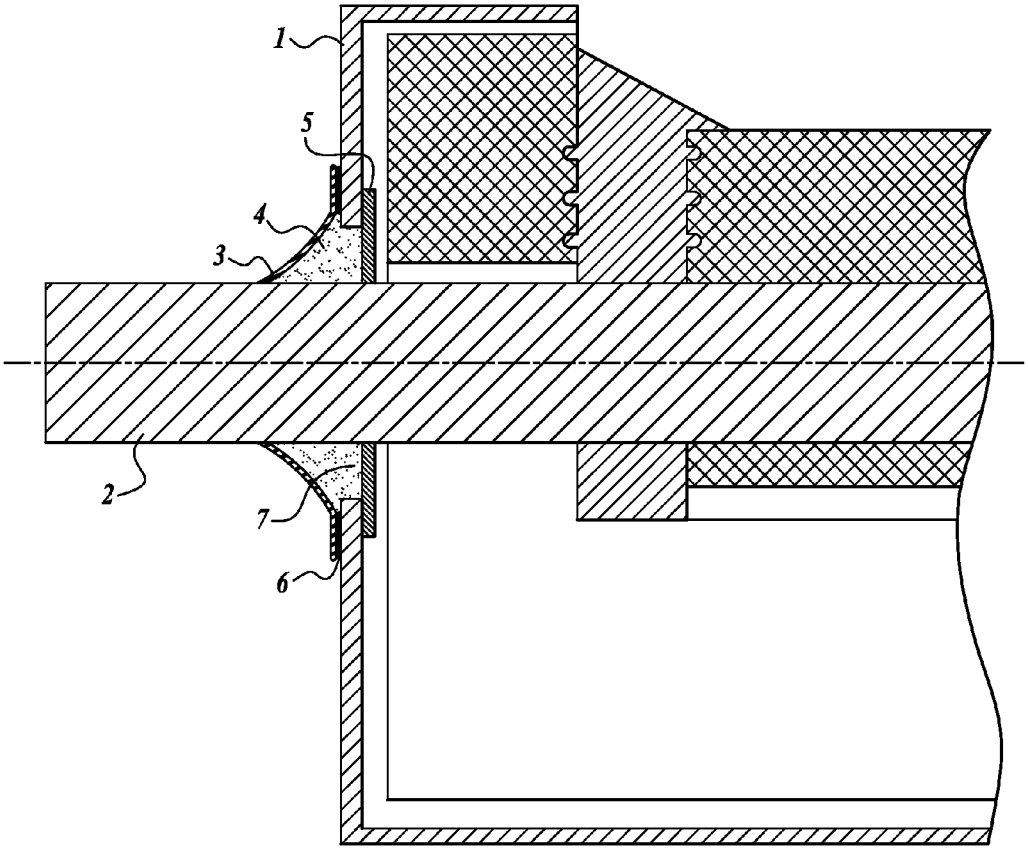
FIG. 1 illustrates an outlet seal for a cathode bar of an aluminum electrolytic cell, in accordance with the disclosed embodiments.

In one aspect, shown in FIG. 1, an outlet seal for a cathode bar of an aluminum electrolytic cell, is provided. In one embodiment, the outlet seal includes a device connected to a lined cathode shell having an aperture for the passage of the cathode bar situated on a face side of the electrolytic cell, characterized in that a plate with an opening is arranged on an inner side of the aperture for the passage of cathode bar, around its periphery, with the ability to move along the cathode bar and cover the aperture; wherein the device is made of a material that is elastic, gas-proof, and heat-proof, in the form of a sleeve that is hermetically connected by one end to the cathode shell, narrows in a direction away from the cathode shell, and hugs the cathode bar around the perimeter of its cross section in such a way as to be able to move synchronously or asynchronously with the movement of the cathode bar; wherein the device contains a sealant comprising an elastic, fire-proof, gas-proof, unshaped filler, that is configured to allow the cathode bar to slide relative to the cathode shell, and ensure that the seal is tight.

In another aspect, a sealing sleeve for a cathode bar of an aluminum electrolytic cell is provided. In one embodiment, the sealing sleeve includes a cathode shell having an aperture for the passage of the cathode bar situated on a face side of the electrolytic cell;

wherein the sealing sleeve is configured to hermetically connect at one end to the cathode shell, narrow in a direction away from the cathode shell, and seal to the cathode bar around a perimeter of its cross section in such a way as to allow synchronous or asynchronous movement of the sealing sleeve with movement of the cathode bar; and wherein the sealing sleeve is made of a material that is elastic, gas-proof, and heat-proof.

Figure 2:
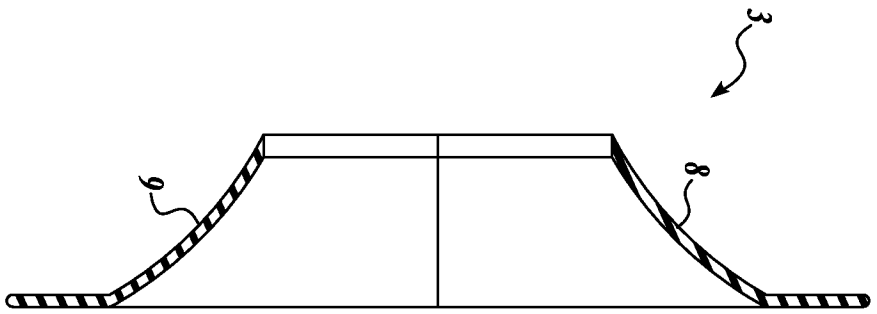
FIG. 2 illustrates a second embodiment of a sleeve of the outlet seal shown in FIG. 1.

In one exemplary embodiment shown in FIG. 2, the sealing sleeve 3 consists of an even number of parts 8 and 9, fastened together during assembly along their longitudinal edges by fastening method selected from the group consisting of adhesion, seaming, staples, and combinations thereof.

Certain features that distinguish the present embodiments from known seals include the following.

First, the device to accommodate the sealing means is in the form of an elastic, gas-proof and heat-proof material in the form of a sleeve, hermetically connected by one widened end to the cathode shell and by the other end not hermetically connected to the cathode bar, but elastically hugging the bar, allowing it not only to move at the start of the movement synchronously with the end of the sleeve, but also to then slide relative to the end of the sleeve, moving asynchronously.

Second, the tightness of the seal is ensured by an elastic connection of the sleeve and the cathode bar, plus additionally by being injected into the sleeve under a relatively slight excess pressure of the elastic, fire-proof, gas-proof, unshaped filler. The properties of the elastic fire-proof material with action of internal forces of surface tension are chosen so that it does not flow out from beneath the free edge of the sleeve, and long preserves its elastic properties, regardless of the high-temperature influence and the chemical action of the aggressive gases, including HF.

Third, the sleeve is secured with ability to move synchronously or asynchronously to the movement of the cathode bar, it has a shape with smaller internal surface area and cost of materials, and also smaller internal space volume between the sleeve and the cathode bar.

The FIGURE illustrates the outlet seal for cathode bars of an aluminum electrolytic cell.

The outlet seal for cathode bars of an aluminum electrolytic cell consists of a cathode shell with apertures 1 for the passage of the cathode bar 2, an elastic sleeve 3, a sealing means 4, and a plate with opening 5. The elastic sleeve 3 is seated on the cathode bar 2 and elastically hugs the cathode bar 2 by one free end, while by the other end it is hermetically connected to the cathode shell with apertures for the passage of the cathode bars 1 by means of a coat of glue 6. The sealing means 4 is injected under a relatively slight excess pressure into the elastic sleeve 3 and also disposed in the gap 7 formed by the cathode bar 2 and the wall of the cathode shell 1. The plate with opening 5 is seated on the cathode bar 2 with ability to move along its axis and is disposed on the inside of the aperture for the passage of the cathode bars of the cathode shell 1, covering it. The sealing means 4 consists of an elastic, fire-proof, gas-proof, unshaped filler, for which it is possible to use, for example, materials of the THERMOSEAL M22 type (Mid-Mountain Materials, Inc., Mercer Island, Wash.). The elastic sleeve 3 is made from elastic, gas-proof and fire-proof material, for which it is possible to use, for example, material of ARMA-TEX type (Mid-Mountain Materials, Inc., Mercer Island, Wash.).

The seal works as follows. In the period of firing and starting the aluminum electrolytic cell and in the process of its operation, due to thermal expansion, the cathode bar 2 moves along its axis, and as a result of sodium expansion of the carbon portion of the lining the cathode bar 2 moves transversely to its axis. One of the ends of the sleeve 3, elastically grasping the cathode bar 2, moves together with the cathode bar 2. The second end of the sleeve 3 is hermetically connected to the cathode shell with apertures for the passage of the cathode bars 1 and remains immovable. The sleeve 3 is stretched and bent in the limits of elastic deformation during the movements of the cathode bar 2 and together with the sealing means 4 it hermetically closes the gap 7 between the cathode bar 2 and the aperture for passage of the cathode bars of the cathode shell 1. The plate with opening 5 does not allow the loose portion of the liner material to penetrate into the cavity between the cathode bar 2 and the elastic sleeve 3.

The outlet seal for cathode bars makes it possible to increase the service life of an aluminum electrolytic cell and eliminate leakage of melt through the apertures for passage of the cathode bars, as well as reduce the costs of the materials used and the labor intensity of the installation work. It improves the repair capacity of the design, since there is no fastening of the end of the sleeve to the moving cathode bar and thanks to the elasticity of the edge of the sleeve it is possible to repeatedly fill the sealing means into the space inside the sleeve when need be. The proposed design helps prevent aggressive gases, especially hydrogen fluoride (HF), from getting outside the shell from underneath the cathode of the electrolytic cell and improves the ecology, as well as increasing the service life of the electrolytic cell by preventing corrosion of the structural materials under the action of aggressive gases.

While illustrative embodiments have been illustrated and described, it will be appreciated that various changes can be made therein without departing from the spirit and scope of the invention.

The embodiments of the invention in which an exclusive property or privilege is claimed are defined as follows:

1. An outlet seal for a cathode bar of an aluminum electrolytic cell, comprising a sealing sleeve connected to a lined cathode shell having an aperture for the passage of the cathode bar situated on a face side of the electrolytic cell, characterized in that a plate with an opening is arranged on an inner side of the aperture for the passage of the cathode bar, around its periphery, with the ability to move along the cathode bar and cover the aperture;

wherein the sealing sleeve is made of a material that is elastic, gas-proof, and heat-proof, in the form of a sleeve that is hermetically connected by one end to the cathode shell, narrows in a direction away from the cathode shell, and hugs the cathode bar around the perimeter of its cross section in such a way as to be able to move synchronously or asynchronously with the movement of the cathode bar;

wherein the sealing sleeve contains a sealant comprising an elastic, fire-proof, gas-proof, unshaped filler, that is configured to engage the cathode bar while allowing the cathode bar to slide relative to the cathode shell, and ensure that the seal is tight.

2. The outlet seal of claim 1, wherein the sealing sleeve consists of an even number of parts, fastened together during assembly along their longitudinal edges by a fastening method selected from the group consisting of adhesion, seaming, staples, and combinations thereof.

3. A sealing sleeve for a cathode bar of an aluminum electrolytic cell comprising a cathode shell having an aperture for the passage of the cathode bar situated on a face side of the electrolytic cell;

wherein the sealing sleeve is configured to hermetically connect at one end to the cathode shell, narrow in a direction away from the cathode shell, and seal the cathode bar around a perimeter of its cross section in such a way as to allow synchronous or asynchronous movement of the sealing sleeve with movement of the cathode bar; and wherein the sealing sleeve is made of a material that is elastic, gas-proof, and heat-proof, and wherein a sealant is disposed between the sealing sleeve and the cathode bar, wherein the sealant is an elastic, fire-proof, gas-proof, unshaped filler, allowing the cathode bar to slide relative to the cathode shell and ensuring a tight seal.

4. The sealing sleeve of claim 3, wherein the sealing sleeve consists of an even number of parts fastened together during assembly along their longitudinal edges by fastening method selected from the group consisting of adhesion, seaming, staples, and combinations thereof.

* * * * *